US010551038B2

(12) United States Patent
Jurik et al.

(10) Patent No.: US 10,551,038 B2
(45) Date of Patent: Feb. 4, 2020

(54) MODULAR MULTISOURCE BEAM SHAPING SYSTEM

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/517,335

(22) Filed: Jul. 19, 2019

(65) Prior Publication Data

US 2019/0338922 A1 Nov. 7, 2019

Related U.S. Application Data

(63) Continuation-in-part of application No. 14/386,316, filed as application No. PCT/US2013/032850 on Mar. 18, 2013.

(Continued)

(51) Int. Cl.

| | |
|---|---|
| ***F21V 14/06*** | (2006.01) |
| ***F21V 5/00*** | (2018.01) |
| *F21Y 115/10* | (2016.01) |

(52) U.S. Cl.

CPC ..... *F21V 14/06* (2013.01); *F21V 5/007* (2013.01); *F21Y 2115/10* (2016.08)

(58) Field of Classification Search

CPC . F21V 14/06; F21V 5/04; F21V 17/02; F21V 23/0435

See application file for complete search history.

(56) References Cited

U.S. PATENT DOCUMENTS 5,665,305 A ‡ 9/1997 Belliveau ..... F21S 10/007 359/23
5,754,896 A * 5/1998 Aoki ..... G03B 3/00 396/144

(Continued)

FOREIGN PATENT DOCUMENTS

CN 1189669 A ‡ 8/1998 ..... G02B 27/09
CN 1253300 A ‡ 5/2000

(Continued)

OTHER PUBLICATIONS

PCT International Search Report; Application No. PCT/US2013/032850; dated Jul. 23, 2013; 5 pages.‡

(Continued)

*Primary Examiner* — Anne M Hines
(74) *Attorney, Agent, or Firm* — Conley Rose, P.C.; Grant Rodolph; Brooks W Taylor

(57) ABSTRACT

A beam shaper module and an automated luminaire are provided. The beam shaper can be installed on or removed from an automated luminaire that produces a plurality of beams of light. The beam shaper module includes a housing, a beam shaper, one or more motors, and a control circuit. The housing detachably couples to a light emitting face of a head of the luminaire. The beam shaper includes an array of ribbed lenses, each lens extending across the beam shaper and receiving light from fewer than all of the light beams. The motor(s) rotate the beam shaper about an axis of rotation coincident with an optical axis of the luminaire. The control circuit receives power and control signals from the luminaire and, in response to the control signals, controls rotation of the beam shaper using the motor(s).

20 Claims, 13 Drawing Sheets

Related U.S. Application Data

(60) Provisional application No. 61/612,374, filed on Mar. 18, 2012.

(56) References Cited

U.S. PATENT DOCUMENTS

| | | | | |
|---|---|---|---|---|
| 5,758,955 | A ‡ | 6/1998 | Belliveau | F21S 10/00 362/29 |
| 5,980,066 | A ‡ | 11/1999 | Belliveau | F21S 8/00 362/28 |
| 6,048,080 | A ‡ | 4/2000 | Belliveau | F21S 10/00 362/28 |
| 7,896,521 | B2 * | 3/2011 | Becker | F21V 14/06 362/239 |
| 2006/0187654 | A1 ‡ | 8/2006 | Jungel-Schmid | F21S 8/02 362/14 |
| 2008/0273324 | A1 ‡ | 11/2008 | Becker | F21V 14/06 362/237 |
| 2009/0310356 | A1 ‡ | 12/2009 | Laporte | F21V 5/007 362/239 |
| 2010/0123954 | A1 * | 5/2010 | Benitez | G02B 3/08 359/626 |
| 2011/0085326 | A1 ‡ | 4/2011 | Jouffrieau | F21V 17/02 362/23 |
| 2019/0170330 | A1 | 6/2019 | Jurik et al. | |

FOREIGN PATENT DOCUMENTS

| | | | | |
|---|---|---|---|---|
| WO | WO-2012020597 | A1 ‡ | 2/2012 | F21S 10/02 |
| WO | WO-2012031598 | A1 ‡ | 3/2012 | F21S 8/00 |

OTHER PUBLICATIONS

PCT Written Opinion of the International Searching Authority; Application No. PCT/US2013/032850; dated Jul. 23, 2013; 4 pages.‡

Chinese Office Action; Application No. 201380024879.7; dated Feb. 27, 2017; 15 pages.‡

Chinese Office Action; Application No. 201380024879.7; dated Nov. 28, 2017; 16 pages.‡

Chinese Notice of Allowance; Application No. 201380024879.7; dated May 3, 2018; 3 pages.‡

European Intention to Grant; Application No. 13724917.3; dated Mar. 22, 2016; 8 pages.‡

European Intention to Grant; Application No. 13724917.3; dated Oct. 14, 2016; 6 pages.‡

Office Action dated May 30, 2019; U.S. Appl. No. 14/386,316, filed Sep. 18, 2014; 13 pages.

Notice of Allowance dated Aug. 19, 2019; U.S. Appl. No. 14/386,316, filed Sep. 18, 2014; 7 pages.

* cited by examiner

‡ imported from a related application

MODULAR MULTISOURCE BEAM SHAPING SYSTEM

CROSS-REFERENCE TO RELATED APPLICATIONS

This application is a continuation in part of U.S. patent application Ser. No. 14/386,316 filed Sep. 18, 2014 by Pavel Jurik, et al. entitled "A Multisource Beam Shaping System", which is a U.S. National Stage of International Patent Application No. PCT/US2013/032850 filed Mar. 18, 2013 by Pavel Jurik, et al. entitled "A Multisource Beam Shaping System", which claims priority to U.S. Provisional Application No. 61/612,374 filed Mar. 18, 2012 by Pavel Jurik, et al. entitled "Beam Shaping System", all of which are incorporated by reference herein as if reproduced in their entirety.

TECHNICAL FIELD OF THE DISCLOSURE

The present disclosure generally relates to automated luminaire(s), specifically to a modular multisource beam shaper for use with an automated luminaire(s).

BACKGROUND OF THE DISCLOSURE

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum, or etched glass pattern. The products manufactured by Robe Show Lighting such as the ColorSpot 700E are typical of the art.

The optical systems of such luminaires may include a beam shaping optical element through which the light is constrained to pass. A beam shaping element may comprise an asymmetric or lenticular lens or collection of lenses that constrain a light beam that is symmetrical and circular in cross section to one that is asymmetrical and predominantly elliptical or rectangular in cross section. A prior art automated luminaire may contain a plurality of such beam shapers each of which may have a greater or lesser effect on the light beam and that may be overlapped to produce a composite effect. For example a weak beam shaper may constrain a circular beam that has a symmetrical beam angle of 20° in all directions into a primarily elliptical beam that has a major axis of 30° and a minor axis of 15°. A more powerful beam shaper may constrain a circular beam that has a symmetrical beam angle of 20° in all directions into a primarily elliptical beam that has a major axis of 40° and a minor axis of 10°. It is also common in prior art luminaires to provide the ability to rotate the beam shaper along the optical axis such that the resultant symmetrical elliptical beam may also be rotated. U.S. Pat. Nos. 5,665,305; 5,758,955; 5,980,066 and 6,048,080 disclose such a system where a plurality of discrete lens elements is used to control the shape of a light beam.

FIG. 1 illustrates a typical multiparameter automated luminaire system 10. These systems commonly include a plurality of multiparameter automated luminaires 12 which typically each contain on-board a light source (not shown), light modulation devices, electric motors coupled to mechanical drive systems and control electronics (not shown). In addition to being connected to mains power either directly or through a power distribution system (not shown), each automated luminaire 12 is connected in series or in parallel to data link 14 to one or more control desks 15. The automated luminaire system 10 is typically controlled by an operator through the control desk 15.

Prior art beam shapers often require installation internally within the luminaire and are not suitable for optical systems where an array of a number of discrete emitters, such as Light Emitting Diodes (LEDs), is used to produce the beam. Instead they rely on the optical path having a focus point that is small compared to the overall diameter of the beam in which the beam shaping can be situated.

There is a need for an improved beam shaper mechanism for automated luminaires that is simple to install or remove from a luminaire, which provides the ability to smoothly and continuously adjust the angle of eccentricity of the constrained light beam for a light beam produced by an array of discrete emitters such as LEDs.

SUMMARY

In a first embodiment, a beam shaper module is configured to be installed on or removed from an automated luminaire that produces a plurality of beams of light. The beam shaper module includes a housing, a beam shaper, one or more motors, and a control circuit. The housing is configured to detachably couple to a light emitting face of a luminaire head of the automated luminaire. The beam shaper includes an array of ribbed lenses, each ribbed lens extending across the beam shaper and receiving light from fewer than all of the beams of light. The motor(s) are configured to rotate the beam shaper about an axis of rotation that is coincident with an optical axis of the automated luminaire. The control circuit is configured to receive electrical power and control signals from the automated luminaire and, in response to the received control signals, to control rotation of the beam shaper using the motor(s).

In a second embodiment, an automated luminaire includes a light source, a beam shaper module, and control electronics. The light source includes a plurality of LEDs and produces a plurality of beams of light that corresponds to the plurality of LEDs. The control electronics are configured to receive control signals via a data link. The beam shaper module includes a housing, a beam shaper that includes lenticular lenses extending across a first surface of the beam shaper, one or more motors, and a control circuit. The housing is configured to detachably couple to a light emitting face of a luminaire head of the automated luminaire. The beam shaper includes an array of ribbed lenses, each ribbed lens extending across the beam shaper and receiving light from fewer than all of the beams of light. The motor(s) are configured to rotate the beam shaper about an axis of rotation coincident with an optical axis of the automated luminaire. The control circuit is configured to receive electrical power from the automated luminaire and control signals from the automated luminaire's control electronics and, in response to the received control signals, to control rotation of the beam shaper using the one or more motor(s).

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the figures, like numerals being used to refer to like and corresponding parts of the various drawings.

The present disclosure generally relates to an automated luminaire, specifically to the configuration of a beam shaper within such a luminaire such that it provides the ability to adjust the size or eccentricity of the constrained light beam.

Figure 1:
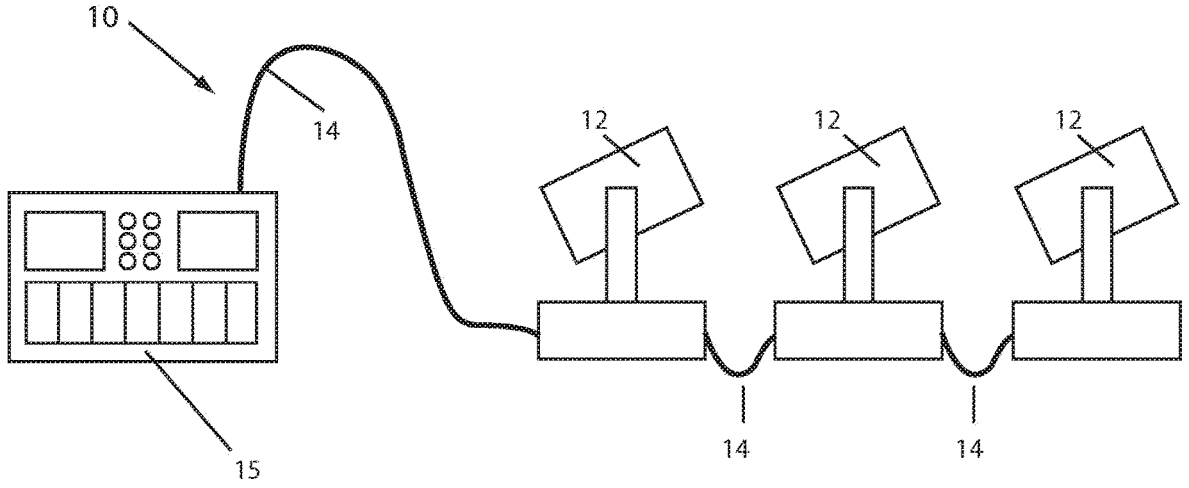
FIG. 1 illustrates a typical automated lighting system.
Figure 2:
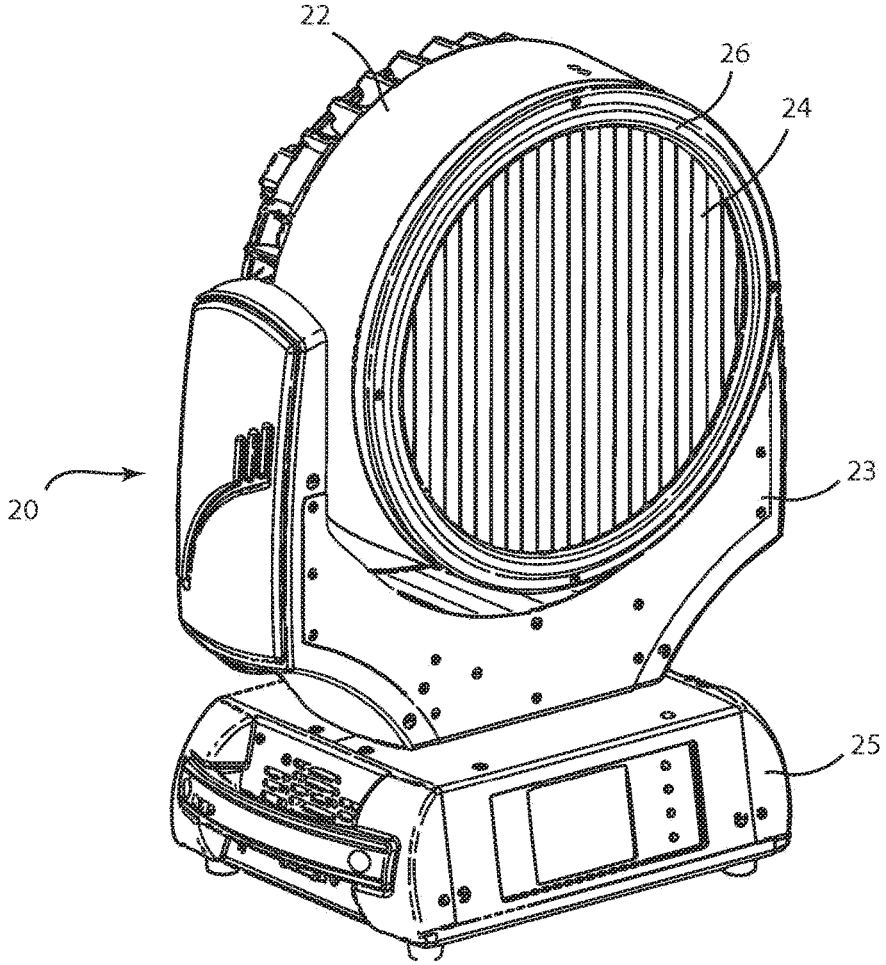
FIG. 2 illustrates an embodiment of the beam shaping system mounted to an automated luminaire.

FIG. 2 illustrates an embodiment of the beam shaping system mounted to an automated luminaire. Automated luminaire 20 comprises base box 25 on which is rotatably mounted yoke assembly 23 which is able to rotate in a first axis relative to base box 25. Luminaire head 22 is rotatably mounted to yoke 23 and is able to rotate in a second axis relative to yoke 23. Beam shaper 24 is mounted in rotatable frame 26 to the front of luminaire head 22. Beam shaper 24 may be rotated around the optical axis of luminaire head 22.

Figure 3:
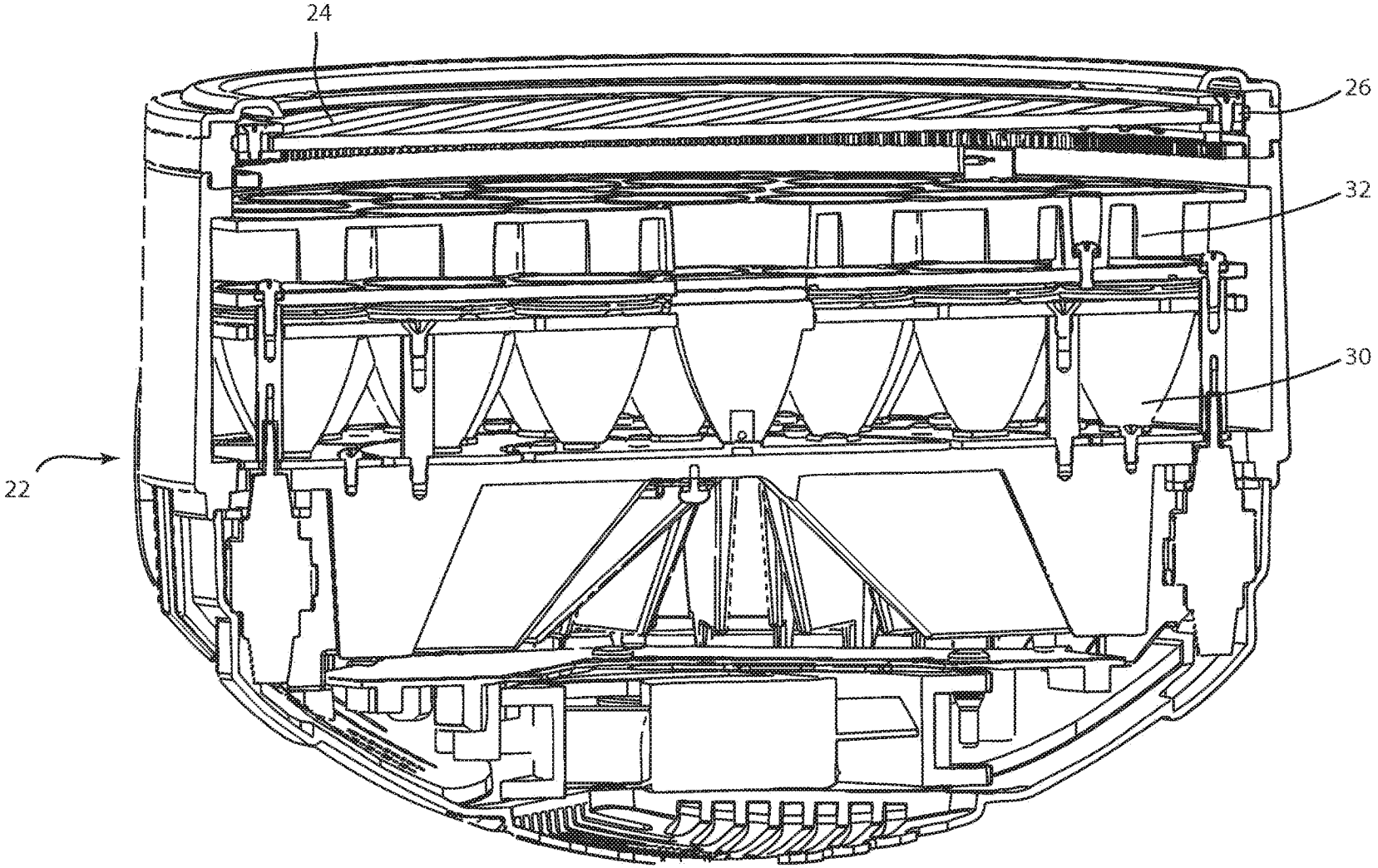
FIG. 3 illustrates a cross sectional view of the beam shaping system mounted to an automated luminaire.
Figure 4:
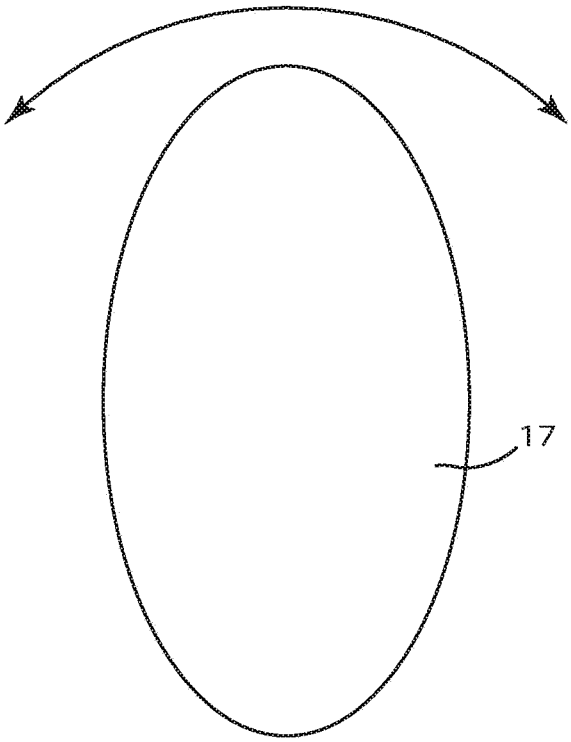
FIG. 4 illustrates a light beam after modulation by a beam shaper.
Figure 5:
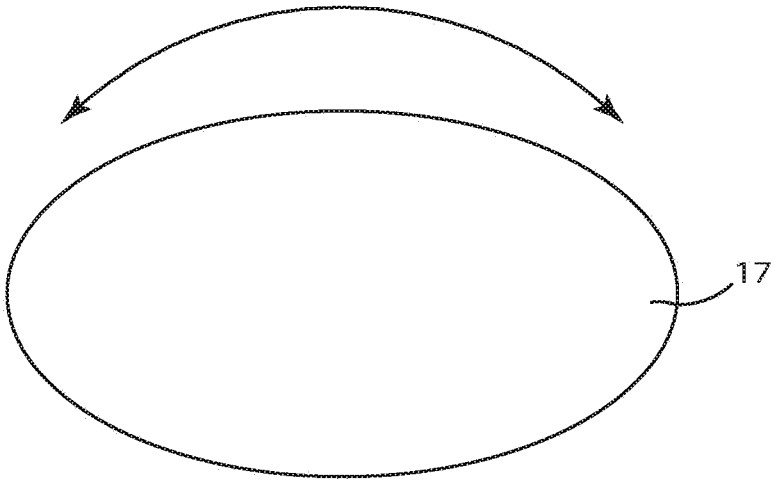
FIG. 5 illustrates a light beam after modulation by a beam shaper.

FIG. 3 illustrates a cross sectional view through luminaire head 22. An array of discrete LED emitters 30 and their associated individual optical systems 32 produce multiple beams of light each of which passes through beam shaper 24. Transmissive beam shaper 24 is mounted in rotatable frame 26 to the front of luminaire head 22. Beam shaper 24 may be rotated around the optical axis of luminaire head 22. In one embodiment, beam shaper 24 may comprise a disk of optically transparent material such as glass, acrylic, or polycarbonate that is embossed or molded with a pattern or array of raised or lowered linear areas to form an array of ribbed or lenticular lenses. When the substantially circular light beam passes through this ribbed or lenticular lens the cross section of that beam will be constrained to a cross section 17 that is asymmetrical and predominantly elliptical or rectangular in shape as shown in FIG. 4. Such a system may be rotated around an axis parallel with the optical axis of the luminaire to rotate the elliptical beam shown in FIG. 4 to the position shown in FIG. 5. The beam shaper 24 may be continuously rotated a full 360° to produce any intermediate result. The user may choose and replace beam shaper 24 with different beam shapers that produce different results in the output beam. For example, beam shapers that produce light beams with a greater or smaller eccentricity angle, asymmetric beam shapers that affect the beam in just one direction, prismatic beam shapers, diffusion beam shapers, holographic beam shapers, lenslet beam shapers, or other beam shapers as known in the art. The system could also be used as a beam diverter using a beam shaper that deflects the light axis through an angle.

Figure 6:
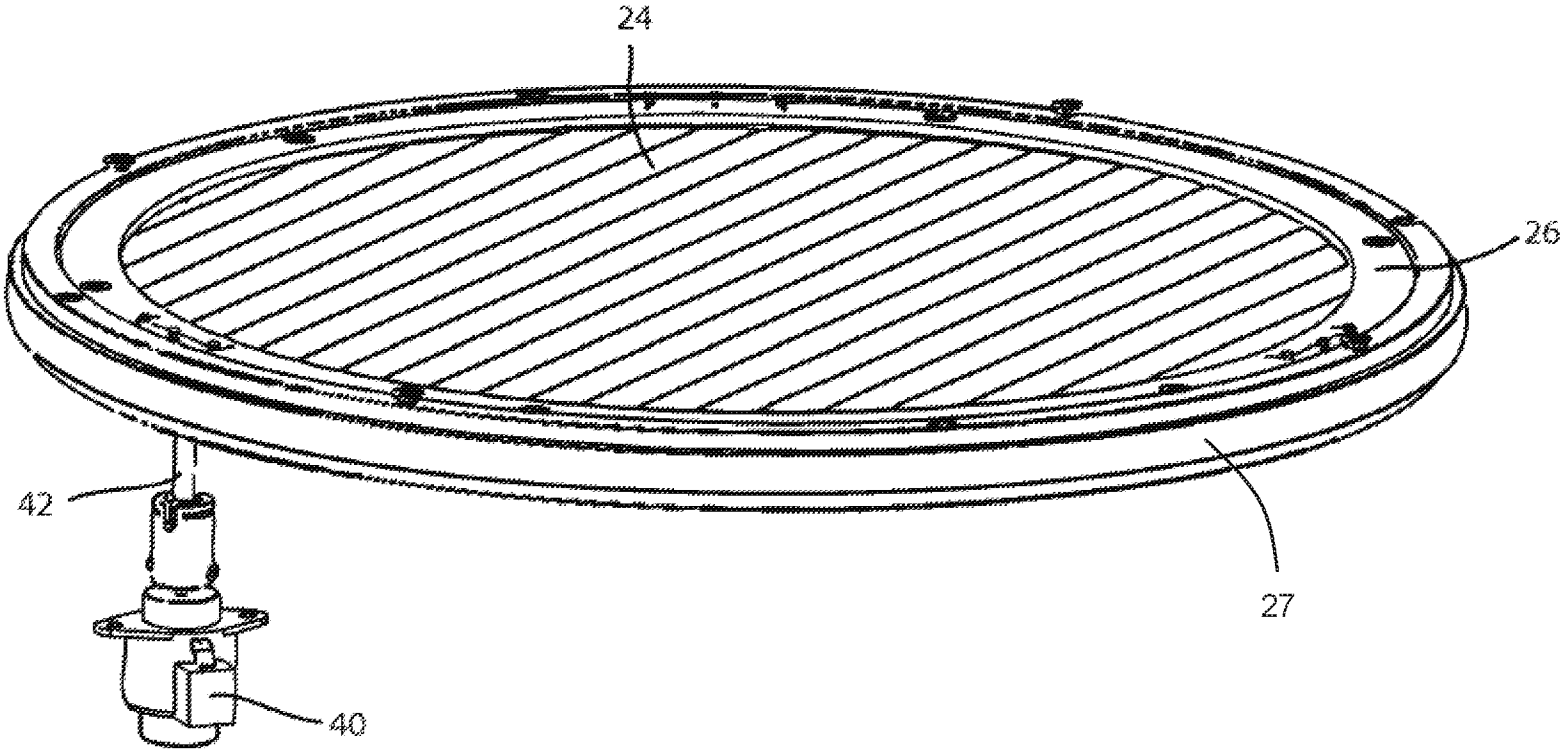
FIG. 6 illustrates an embodiment of the beam shaping system.
Figure 7:
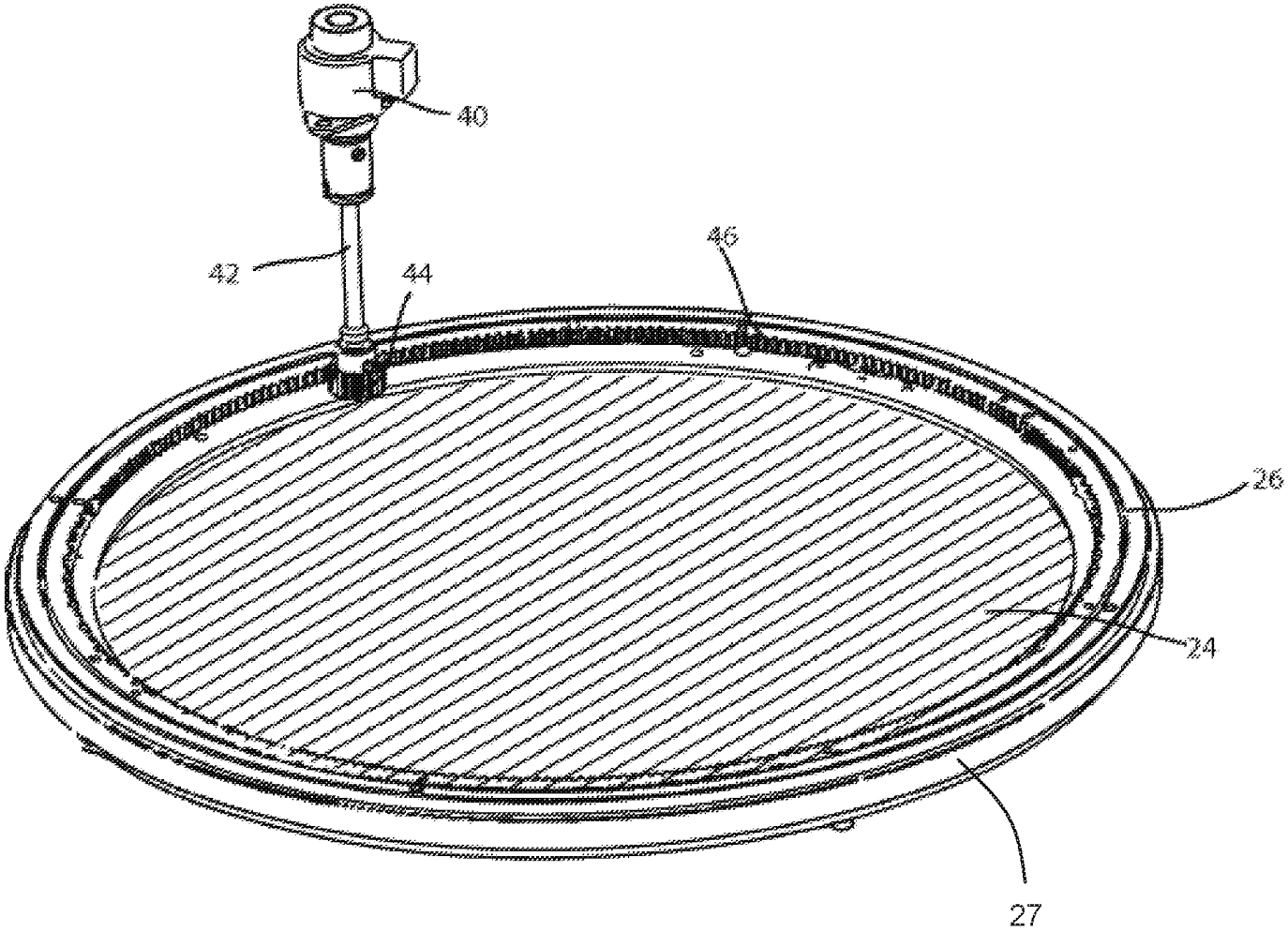
FIG. 7 illustrates an embodiment of the beam shaping system.
Figure 8:
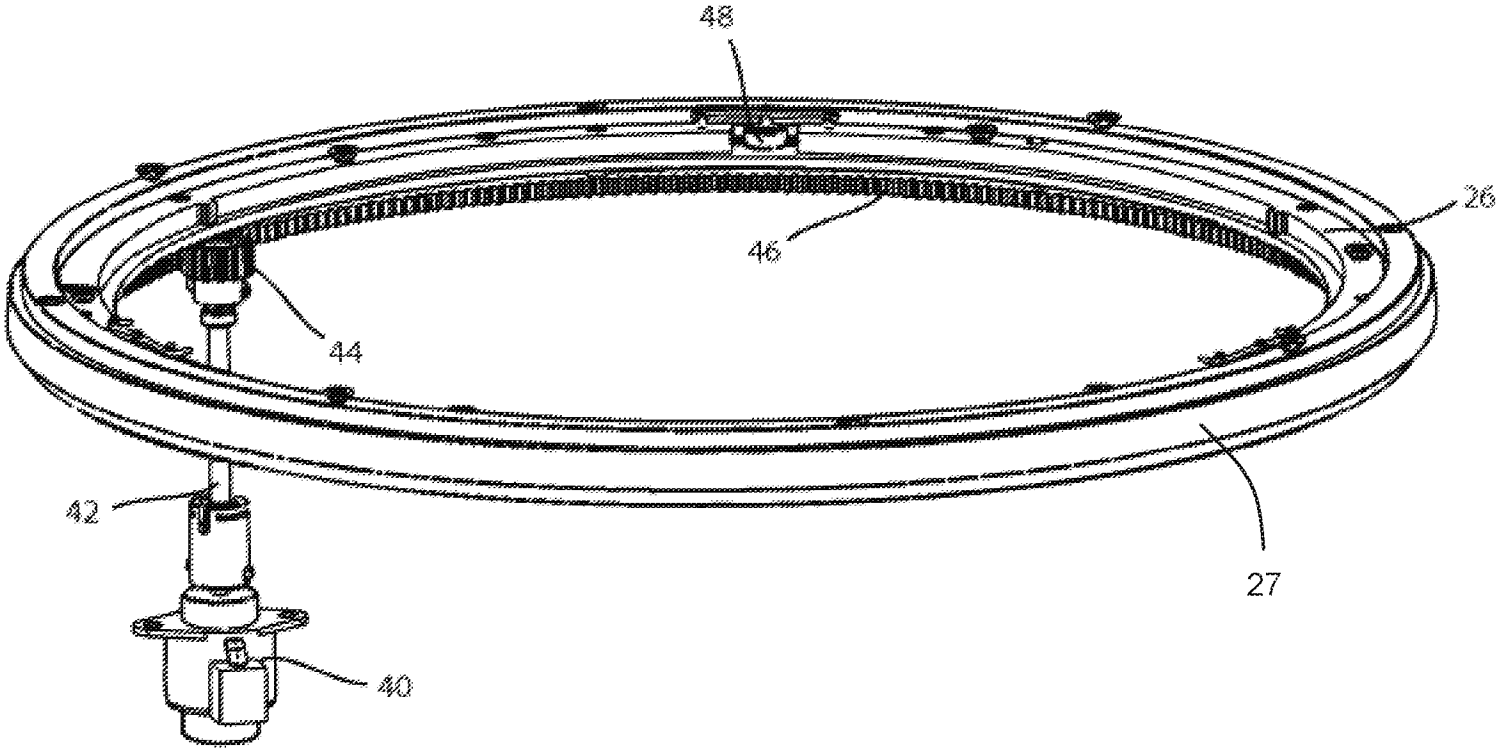
FIG. 8 illustrates an embodiment of the beam shaping system.

FIGS. 6, 7 and 8 illustrate an embodiment of the beam shaping system removed from the luminaire for clarity. Beam shaper 24 is mounted within rotatable frame 26. Motor 40 drives shaft 42 and thus pinion gear 44. Pinion gear 44 in turn engages with and drives ring gear 46 which is part of rotatable frame 26. Rotatable frame 26 is free to rotate within bearings 48 that are mounted to fixed frame 27. Because of the large gear ratio between pinion gear 44 and ring gear 46, rotatable frame 26 may be rotated smoothly and positioned accurately. Motor 40 may be a stepper motor, or other motor known in the art such as a servo motor.

Figure 9:
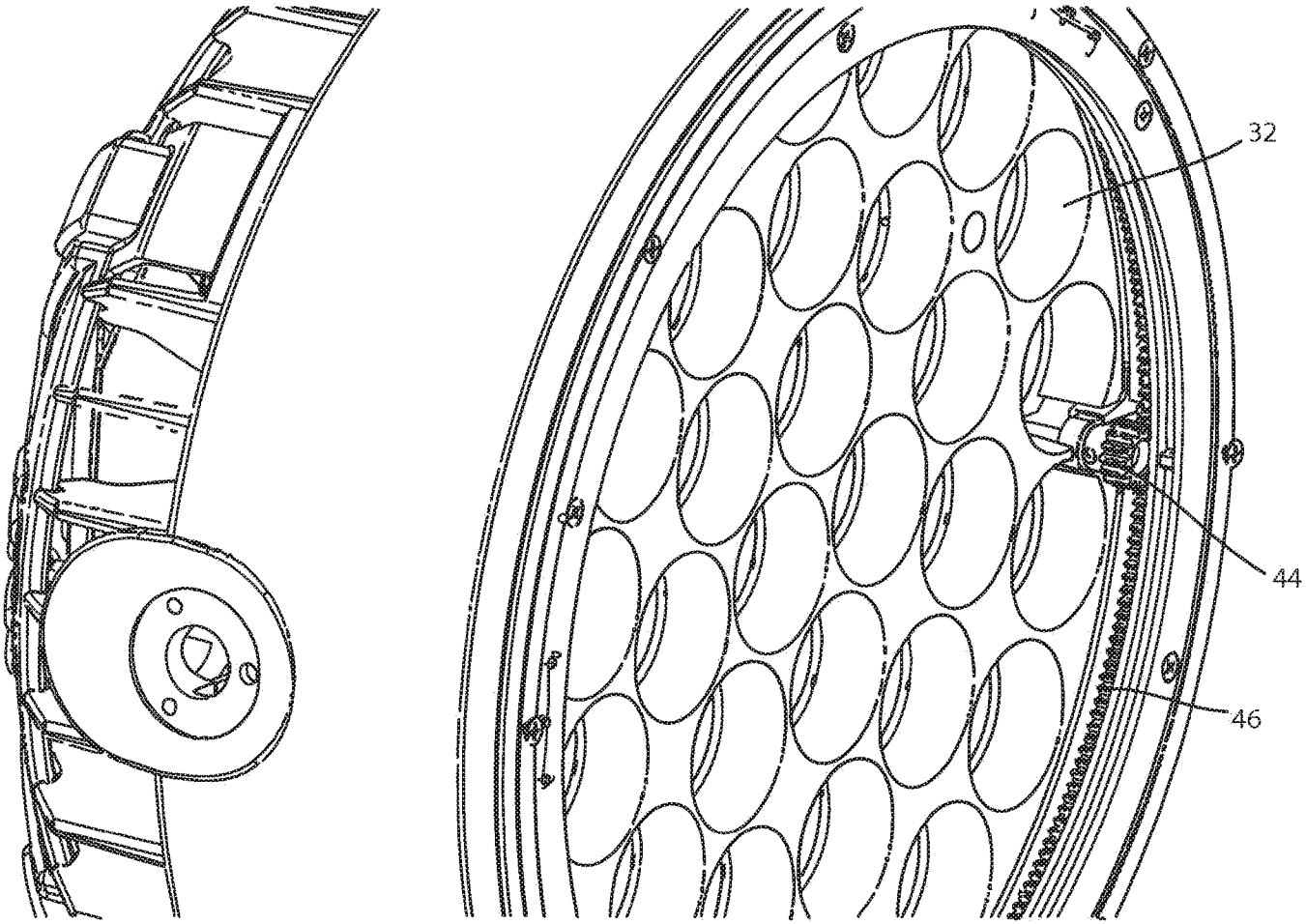
FIG. 9 illustrates an embodiment of the beam shaping system mounted to an automated luminaire.
Figure 10:
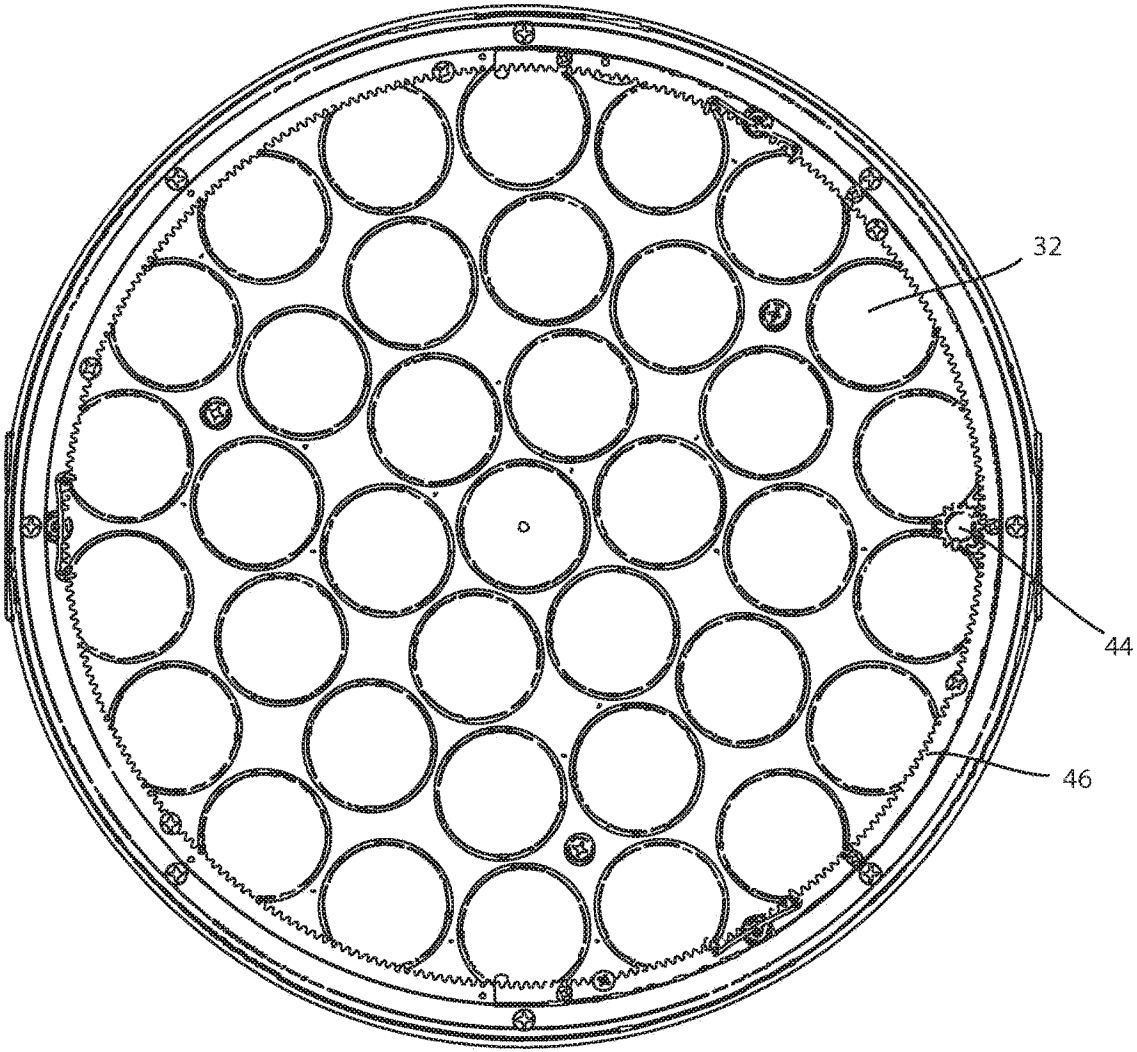
FIG. 10 illustrates an elevation view of an embodiment of the beam shaping system mounted to an automated luminaire.

FIGS. 9 and 10 illustrate an embodiment of the beam shaper as mounted to an automated luminaire. In this figure the beam shaper 24 is omitted to allow the construction to be seen. Pinion gear 44 engages with and drives ring gear 46 so as to rotate the beam shaper (omitted for clarity) in front of the array of LED output optics 32. Pinion gear 44 is small and does not materially interfere with the light beam from adjacent emitters, nor does the system cause any appreciable increase in the size of the automated luminaire. Such a system is extremely flexible, its position on the outside front of the automated luminaire makes it simple for the user to change the beam shaper to any design that they wish to achieve the desired effect. Alternatively, it can easily be completely removed to allow the system to revert back to its native beam shape.

Figure 11:
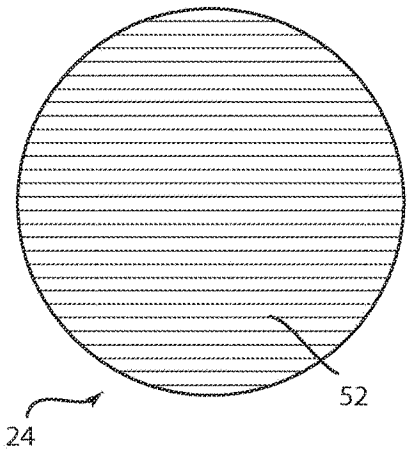
FIGS. 11-16 illustrate embodiments of the beam shaper.
Figure 12:
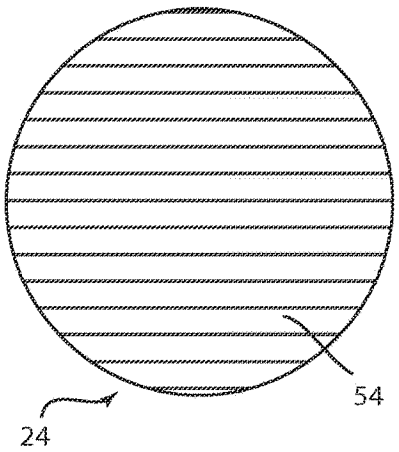
Figure 13:
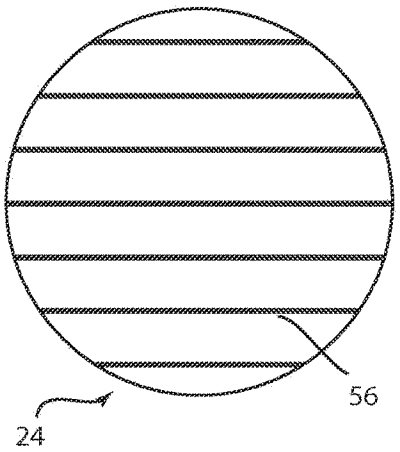
Figure 14:
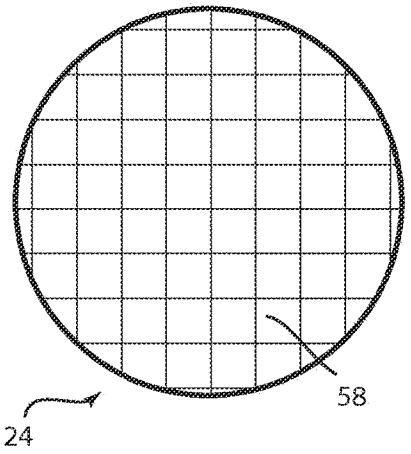
Figure 15:
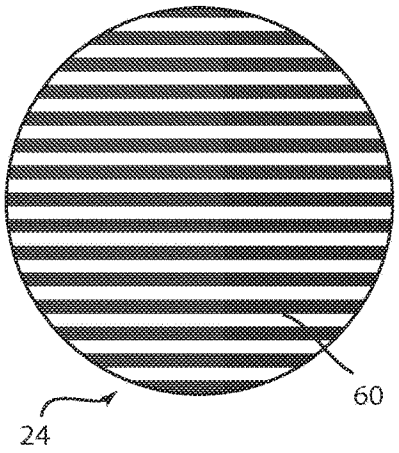
Figure 16:
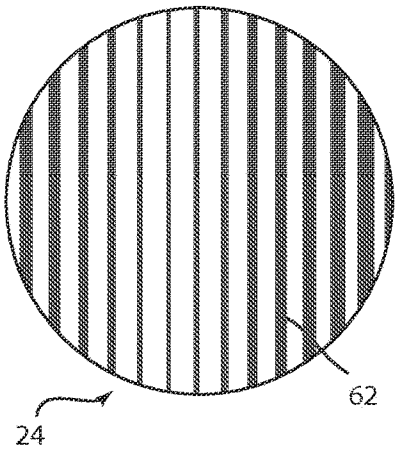

FIGS. 11-16 show embodiments of the beam shaper 24. FIGS. 11, 12 and 13 represent beam shapers having differing angles, where beam shaper 52 is a wide angle asymmetric lens array, beam shaper 54 is a medium angle asymmetric lens array, and beam shaper 56 is a narrow angle asymmetric lens array. FIGS. 14, 15 and 16 are examples of still other beam shapers that may be used. Beam shaper 58 is a grid array of lenticular lenses, beam shaper 60 is a linear array of prisms forming an offset beam, and beam shaper 62 is a linear array of random angle prisms forming a complex asymmetric beam. In every case the beam shaper 24 may be rotated so as to rotate the effect produced.

In an alternative embodiment (not shown) the beam shaper 24 could be a portion of a disc instead of a full disc so that it only covers and affects a portion of the LEDs.

Figure 17:
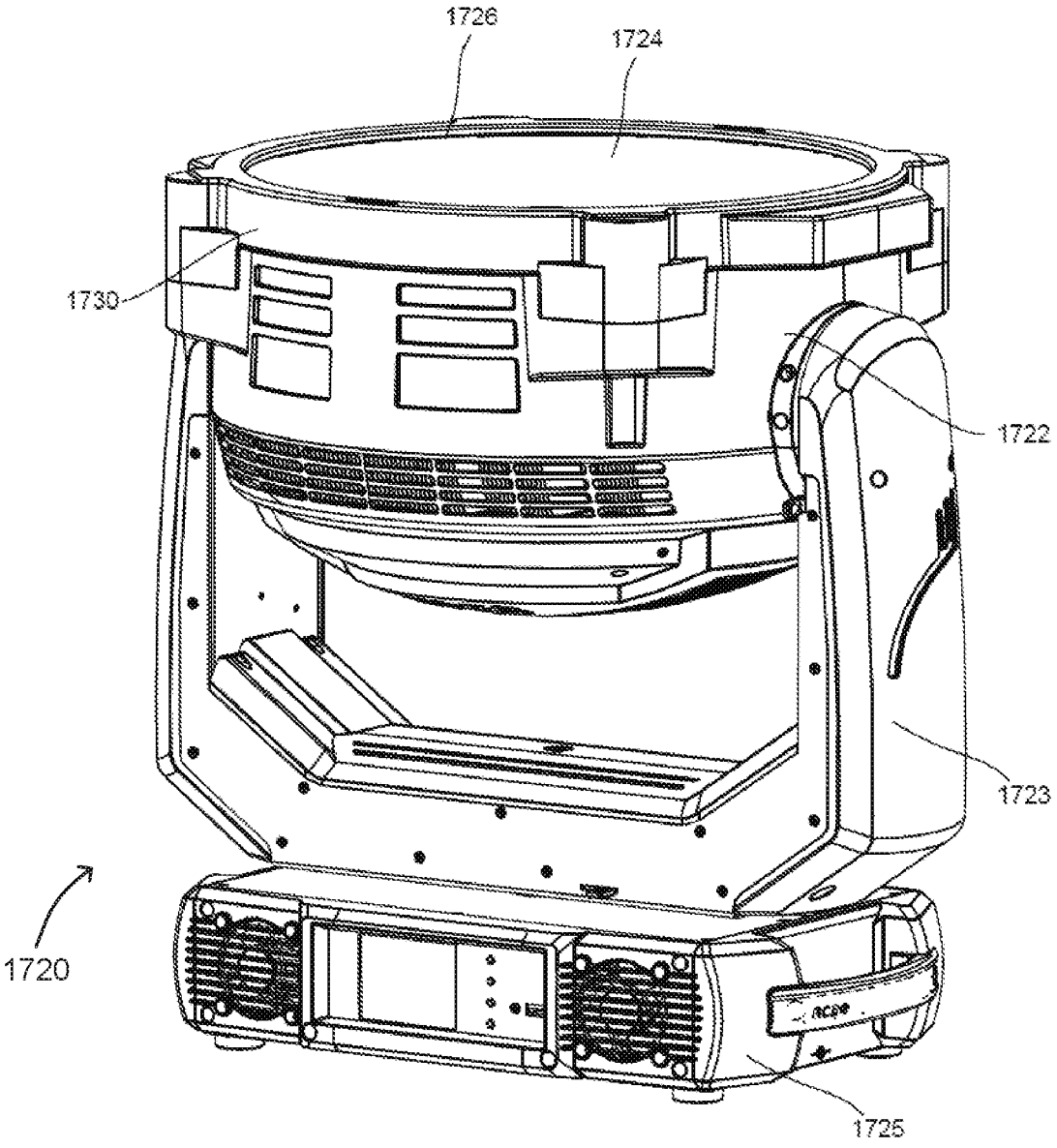
FIG. 17 illustrates a removable modular beam shaper module according to the disclosure attached to an automated luminaire.

FIG. 17 illustrates a removable beam shaper module 1730 according to the disclosure attached to an automated luminaire 1720. In this embodiment the beam shaper is constructed as a module that may be installed on or removed from the automated luminaire 1720 as desired by the user. The automated luminaire 1720 comprises a base box 1725 on which is rotatably mounted a yoke assembly 1723, which is configured to rotate about a first axis relative to the base housing 1725. A luminaire head 1722 is rotatably mounted to the yoke 1723 and is able to rotate about a second axis relative to the yoke 1723. The beam shaper module 1730 is configured to detachably couple mechanically to the front (or light emitting face) of the luminaire head 1722. The beam shaper 1724 is mounted in a rotatable frame 1726 in the beam shaper module 1730. The beam shaper module 1730 is mounted concentrically with the luminaire head 1722 such that the beam shaper 1724 may be rotated around an optical axis of the luminaire head 1722.

Figure 18:
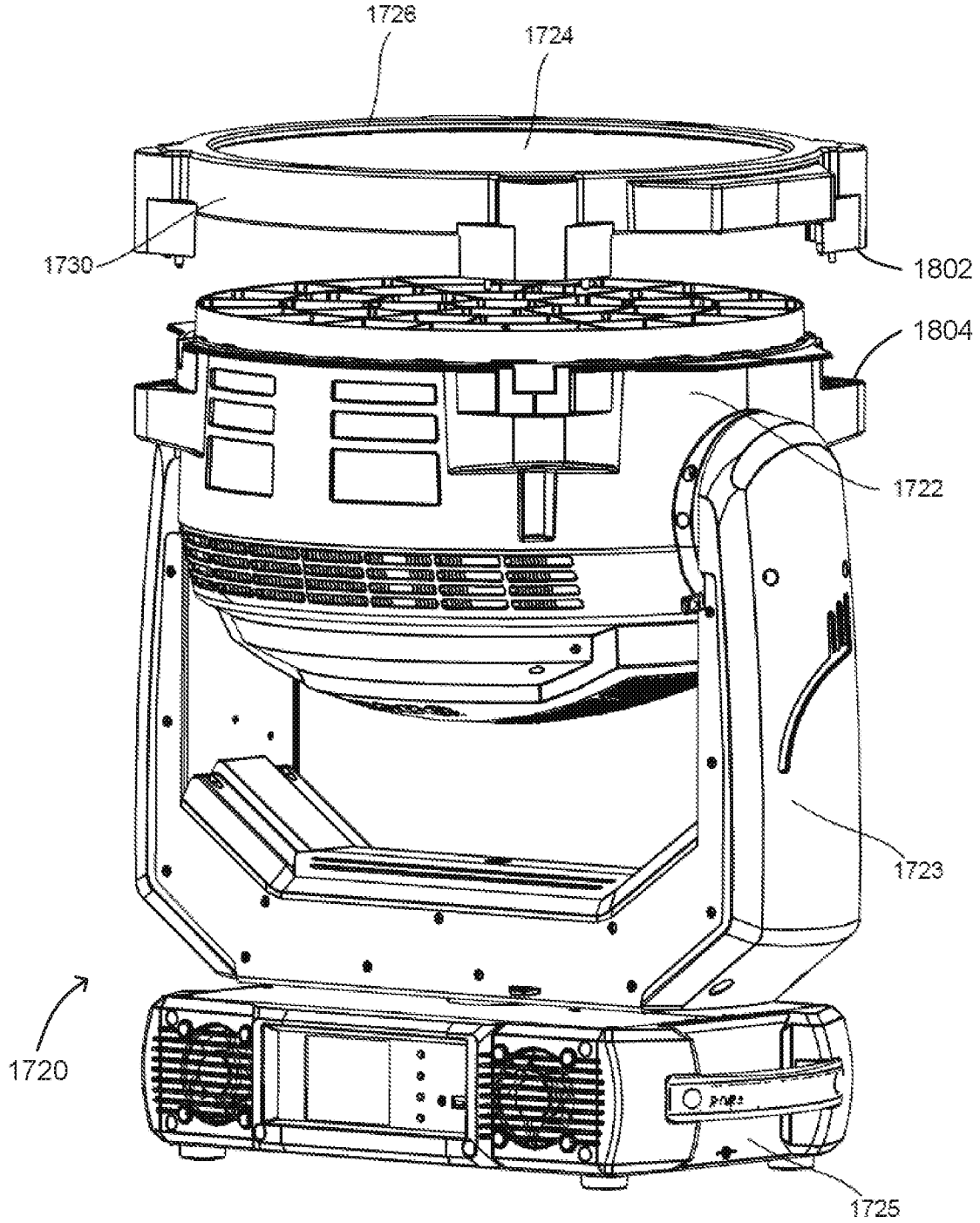
FIG. 18 illustrates the removable modular beam shaper of FIG. 17 removed from the automated luminaire.

FIG. 18 illustrates the removable beam shaper module 1730 of FIG. 17 removed from the automated luminaire 1720. The beam shaper module 1730 may be mechanically coupled to the luminaire head 1722 using springs, screws, pins, clips, magnets, or other suitable fastening means so that the beam shaper module 1730 may readily be attached or removed as a complete unit. The beam shaper module 1730 may be electrically connected to the luminaire head 1722 via cabling, connectors or other means well known in the art. In one embodiment, an electrical cable may couple a first electrical connector of the beam shaper module 1730 to a second electrical connector of the luminaire head 1722. In another embodiment, a first electrical connector 1802 of the beam shaper module 1730 may directly mate with a second electrical connector 1804 of the luminaire head 1722. These electrical connections are configured to provide electrical power and control signals to the beam shaping module 1730 from control electronics of the automated luminaire 1720.

Figure 19:
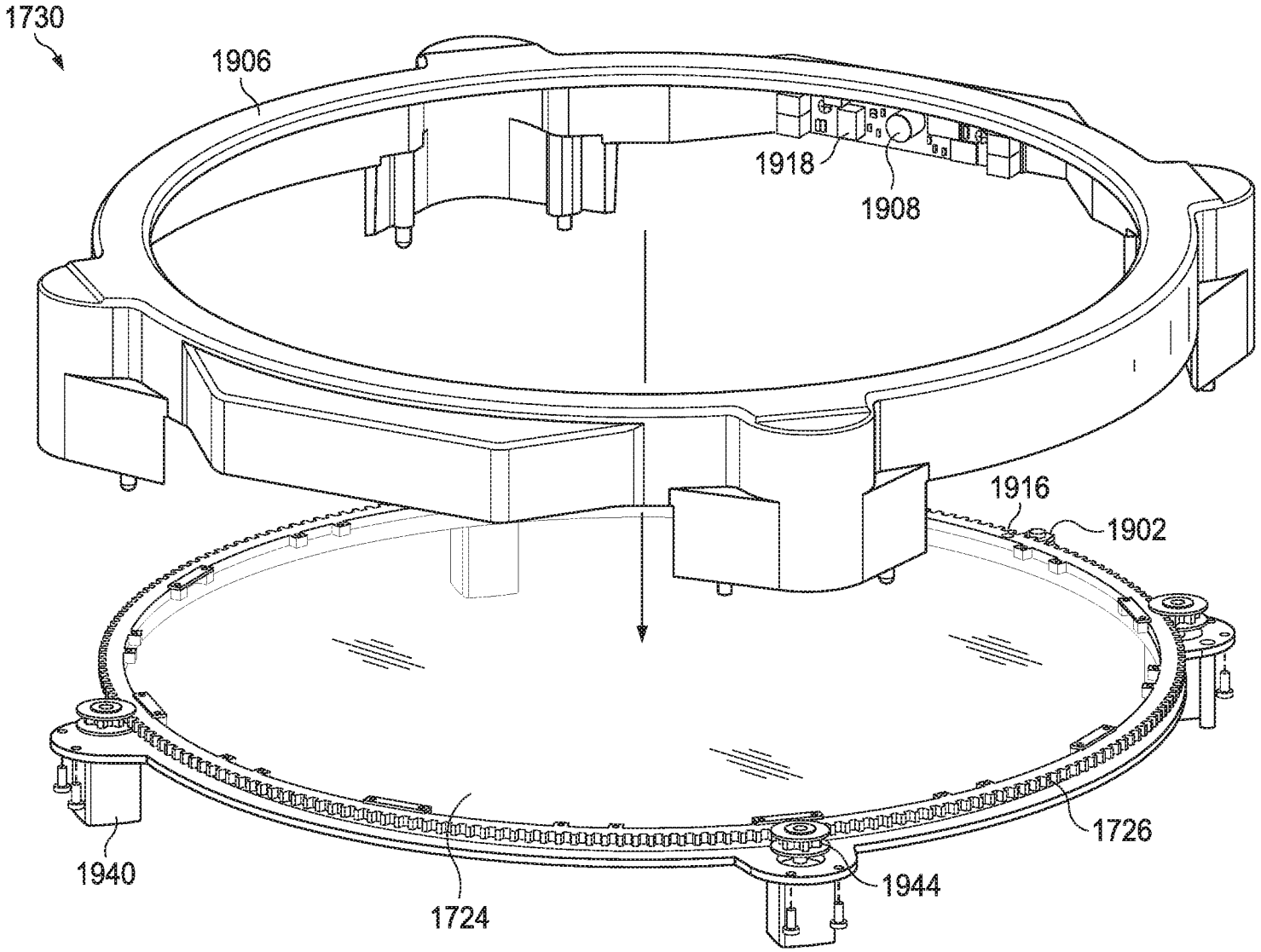
FIG. 19 presents an exploded view of the removable modular beam shaper module of FIG. 17.

FIG. 19 presents an exploded view of the removable beam shaper module 1730 of FIG. 17. The beam shaper module 1730 comprises a housing 1906 that is configured to detachably couple mechanically to the luminaire head 1722. The housing 1906 includes a control circuit 1908, motors 1940, the rotatable frame 1726, the beam shaper 1724, and an electrical connector 1902. The motors 1940 drive the rotation of the rotatable frame 1726 through pinion gears 1944 mounted on the shafts of motors 1940. The pinion gears 1944 engage with gear teeth on an edge of the rotatable frame 1726. In other embodiments, the motors 1940 may drive the rotatable frame 1726 through belts or pulley systems. In still other embodiments, the rotatable frame 1726 may be driven by fewer or more than the four motors 1940. The control circuit 1904 includes power supplies and circuits for motor control, sensor, and motor drivers and is configured to control the angle of rotation of rotation of the rotatable frame 1726 and thus the angle of rotation of the beam shaper 1724.

The control circuit 1908 receives electrical power and control signals from the automated luminaire 1720 via the connector 1902. The control circuit 1908 may be electrically connected to the connector 1902 via cabling, connectors or other means well known in the art. In one embodiment, an electrical cable may couple the control circuit 1908 to the connector 1902. In another embodiment, an electrical connector of the control circuit 1908 may directly mate with the connector 1902. In response to such control signals received from the automated luminaire 1720 via the connector 1902, the control circuit 1908 is configured power the motors 1940 to rotate the rotatable frame 1726 and the beam shaper 1724 to a specified angle of rotation and/or at a specified rate of rotation.

The control circuit 1908 includes a Hall sensor 1918 configured to sense a magnet 1916 that is mounted on the rotatable frame 1726. The magnet 1916 is a position indicator that provides the control circuit 1908 with an index indication of a known angle of rotation (position) of the rotatable frame 1726. The control circuit 1908 is configured to calibrate the angle of rotation of the rotatable frame 1726 at power up of the automated luminaire 1720 using the Hall sensor 1918 and the magnet 1916. In other embodiments of beam shapers according to the disclosure, other suitable sensors and position indicators, including absolute position sensors and indicators configured to sense an absolute angle of rotation of the rotatable frame 1726 at power up, may be used.

Figure 20:
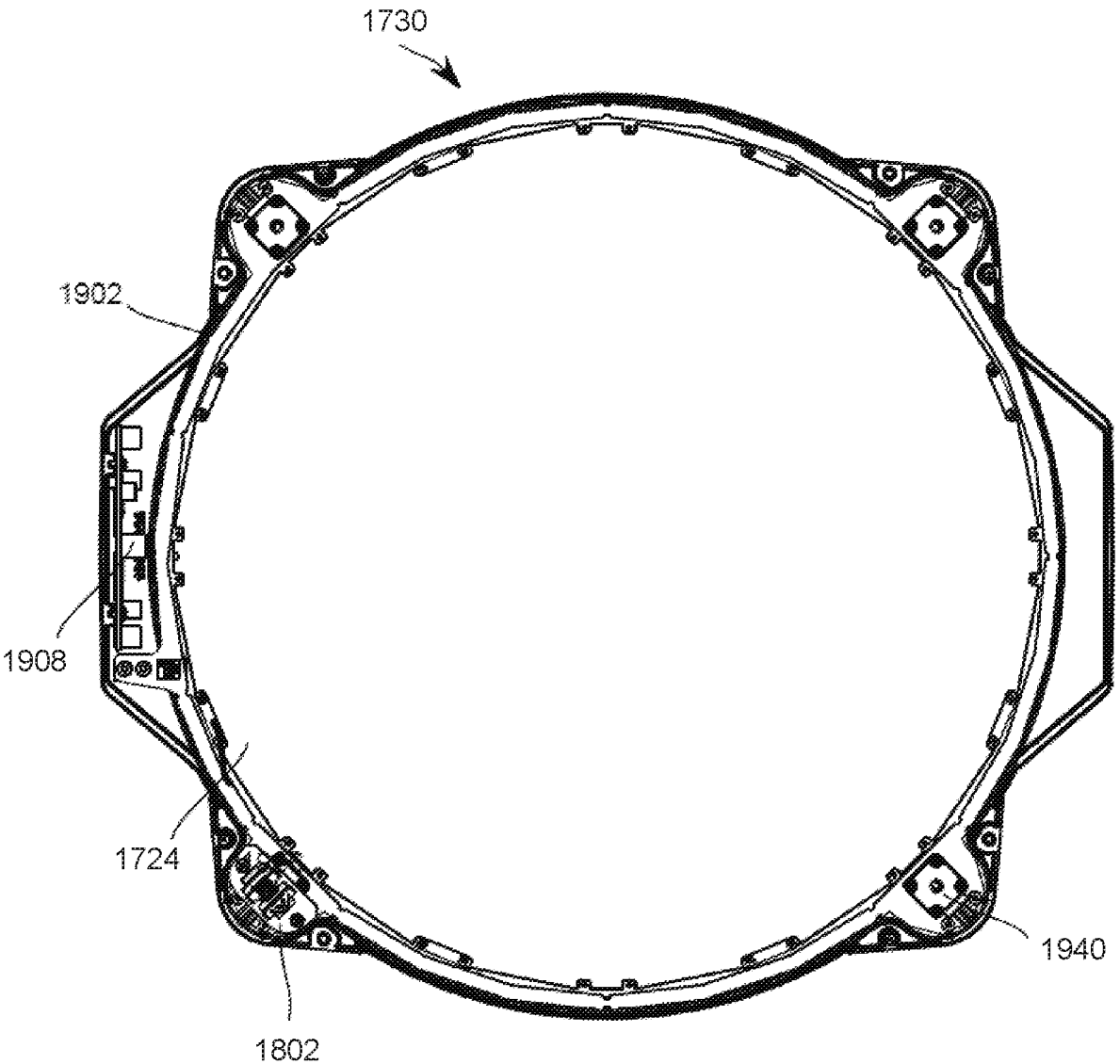
FIG. 20 presents a back view of the removable modular beam shaper module of FIG. 17.

FIG. 20 presents a back view of the removable modular beam shaper module 1730 of FIG. 17. The beam shaper module 1730 is shown assembled in FIG. 20 and various elements of the beam shaper module 1730 that were previously described with reference to FIGS. 17-19 are indicated.

It should be appreciated that in any cases where articulation of elements is called for herein but not shown, it is well within the known art to provide a variety of mechanisms that can achieve these necessary articulations.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

What is claimed is:

1. A beam shaper module, configured to be installed on or removed from an automated luminaire, the automated luminaire producing a plurality of beams of light, the beam shaper module comprising:

a housing configured to detachably couple to a light emitting face of a luminaire head of the automated luminaire;

a beam shaper comprising an array of ribbed lenses, each ribbed lens extending across the beam shaper, where each ribbed lens receives light from fewer than all of the plurality of beams of light;

one or more motors configured to rotate the beam shaper about an axis of rotation coincident with an optical axis of the automated luminaire; and a control circuit configured to receive electrical power and control signals from the automated luminaire and, in response to the received control signals, to control rotation of the beam shaper using the one or more motors.

2. The beam shaper module of claim 1, wherein the control circuit is configured to electrically couple via a connector to the automated luminaire to receive the electrical power and the control signals from the automated luminaire.

3. The beam shaper module of claim 1, wherein the control circuit is configured to rotate the beam shaper at a rate of rotation specified in a control signal received from the automated luminaire.

4. The beam shaper module of claim 1, wherein:

the beam shaper module comprises a rotatable frame;

the beam shaper is mounted in the rotatable frame; and the one or more motors are configured to rotate the beam shaper by rotating the rotatable frame.

5. The beam shaper module of claim 4, wherein:

the beam shaper is a first beam shaper and the shaped light beam has a first shape; and the rotatable frame is configured to allow replacement of the first beam shaper with a second beam shaper configured to produce a shaped light beam having a second shape, where the second shape is different from the first shape.

6. The beam shaper module of claim 4, wherein the rotatable frame comprises a ring gear and at least one of the one or more motors comprises a pinion gear configured to rotate the rotatable frame via the ring gear.

7. The beam shaper module of claim 4, wherein the rotatable frame is configured to rotate continuously.

8. The beam shaper module of claim 4, wherein:

the rotatable frame comprises a position indicator;

the control circuit comprises a sensor configured to sense the position indicator; and the control circuit is configured to calibrate an angle of rotation of the rotatable frame using the position indicator and the sensor.

9. The beam shaper module of claim 8, wherein the control circuit is configured to rotate the beam shaper to an angle of rotation specified in a control signal received from the automated luminaire.

10. The beam shaper module of claim 8, wherein the position indicator and sensor comprise an absolute position sensing system configured to sense an absolute angle of rotation of the rotatable frame when the control circuit is first powered up.

11. An automated luminaire, comprising:

a light source comprising a plurality of light emitting diodes (LEDs), the light source producing a plurality of beams of light corresponding to the plurality of LEDs;

a beam shaper module; and control electronics configured to receive control signals via a data link, wherein the beam shaper module comprises:

a housing configured to detachably couple to a light emitting face of a luminaire head of the automated luminaire;

a beam shaper comprising an array of ribbed lenses, each ribbed lens extending across the beam shaper, where each ribbed lens receives light from fewer than all of the plurality of beams of light;

one or more motors configured to rotate the beam shaper about an axis of rotation coincident with an optical axis of the automated luminaire; and a control circuit configured to receive electrical power from the automated luminaire and control signals from the control electronics of the automated luminaire and, in response to the received control signals, to control rotation of the beam shaper using the one or more motors.

12. The automated luminaire of claim 11, wherein the control circuit is configured to electrically couple via a connector to the automated luminaire to receive the electrical power from the automated luminaire and the control signals from the control electronics of the automated luminaire.

13. The automated luminaire of claim 11, wherein the control circuit is configured to rotate the beam shaper at a rate of rotation specified in a control signal received from the control electronics of the automated luminaire.

14. The automated luminaire of claim 11, wherein:

the beam shaper module comprises a rotatable frame;

the beam shaper is mounted in the rotatable frame; and the one or more motors are configured to rotate the beam shaper by rotating the rotatable frame.

15. The automated luminaire of claim 14, wherein:

the beam shaper is a first beam shaper and the shaped light beam has a first shape; and the rotatable frame is configured to allow replacement of the first beam shaper with a second beam shaper configured to produce a shaped light beam having a second shape, where the second shape is different from the first shape.

16. The automated luminaire of claim 14, wherein the rotatable frame comprises a ring gear and at least one of the one or more motors comprises a pinion gear configured to rotate the rotatable frame via the ring gear.

17. The automated luminaire of claim 14, wherein the rotatable frame is configured to rotate continuously.

18. The automated luminaire of claim 14, wherein:

the rotatable frame comprises a position indicator;

the control circuit comprises a sensor configured to sense the position indicator; and the control circuit is configured to calibrate an angle of rotation of the rotatable frame using the position indicator and the sensor.

19. The automated luminaire of claim 18, wherein the control circuit is configured to rotate the beam shaper to an angle of rotation specified in a control signal received from the control electronics of the automated luminaire.

20. The automated luminaire of claim 18, wherein the position indicator and sensor comprise an absolute position sensing system configured to sense an absolute angle of rotation of the rotatable frame when the control circuit is first powered up.

* * * * *